US008740501B2

(12) United States Patent
Maher et al.

(10) Patent No.: US 8,740,501 B2
(45) **Date of Patent: *Jun. 3, 2014**

(54) APPARATUS AND METHOD FOR GROUND IMPROVEMENT

(75) Inventors: Stephen A. Maher, Roswell, GA (US); Kord J. Wissmann, Mooresville, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 22 days.

This patent is subject to a terminal disclaimer.

(21) Appl. No.: 13/339,512

(22) Filed: Dec. 29, 2011

(65) Prior Publication Data

US 2012/0183361 A1 Jul. 19, 2012

Related U.S. Application Data

(63) Continuation-in-part of application No. 12/792,258, filed on Jun. 2, 2010, now Pat. No. 8,328,470.

(60) Provisional application No. 61/219,814, filed on Jun. 24, 2009.

(51) Int. Cl.
*E02D 3/02* (2006.01)
*E02D 3/08* (2006.01)

(52) U.S. Cl.
USPC ..... 405/233; 405/271

(58) Field of Classification Search
USPC ..... 405/231–233, 240, 242, 129.15, 271, 405/302.4, 302.5; 172/21; 404/133.05, 404/133.1, 133.2
See application file for complete search history.

(56) References Cited

U.S. PATENT DOCUMENTS

| | | | |
|---|---|---|---|
| 794,971 | A | 7/1905 | Ericsson |
| 5,152,348 | A | 10/1992 | Flanagan, Sr. et al. |
| 5,249,892 | A | 10/1993 | Fox et al. |
| 6,354,766 | B1 | 3/2002 | Fox |
| 6,425,713 | B2 | 7/2002 | Fox et al. |
| 6,505,998 | B1 | 1/2003 | Bullivant |
| 7,226,246 | B2 | 6/2007 | Fox |
| 7,326,004 | B2 | 2/2008 | Wissmann et al. |
| 2005/0274532 | A1 | 12/2005 | Lephart et al. |
| 2006/0088388 | A1 | 4/2006 | Wissmann et al. |
| 2008/0205993 | A1 | 8/2008 | Wissmann et al. |

FOREIGN PATENT DOCUMENTS

| | | | |
|---|---|---|---|
| EP | 299118 | A1 | 1/1989 |
| EP | 514559 | A1 | 11/1992 |
| GB | 2286613 | A | 8/1995 |
| JP | 08-296252 | | 11/1996 |
| JP | 2001140247 | A | 5/2001 |

*Primary Examiner* — Sunil Singh
(74) *Attorney, Agent, or Firm* — Ward and Smith, P.A.

(57) ABSTRACT

An apparatus and method for ground improvement includes a device having a plurality of tines extending downwardly from a top plate in a manner to achieve displacement of ground material downward and radially outward. The device is mechanically driven into the ground to achieve predetermined depths of penetration by the tines. The device is retracted and driven repeatedly to achieve densification. Optionally, voids made by the device can be filled with a flowable media.

20 Claims, 14 Drawing Sheets

APPARATUS AND METHOD FOR GROUND IMPROVEMENT

CROSS-REFERENCE TO RELATED APPLICATIONS

This patent application is a continuation-in-part of, is related to, and claims priority to U.S. patent application Ser. No. 12/792,258, filed Jun. 2, 2010, which is related to and claims priority to U.S. Provisional Application Ser. No. 61/219,814, filed Jun. 24, 2009. The entire disclosures of said applications are specifically incorporated by reference herein.

FIELD OF THE INVENTION

The present invention is related to an apparatus and method for improving the strength and stiffness of soil by treating the soil with a displacement device having a plurality of tines, and optionally subsequently filling voids made by the device with flowable media such as, for example, sand, gravel, recycled materials, waste materials, tire chips, grout, or concrete.

BACKGROUND OF THE INVENTION

Heavy or settlement-sensitive facilities that are located in areas containing soft, loose, or weak soils are often supported on deep foundations. Such deep foundations are typically made from driven pilings or concrete piers installed after drilling. The deep foundations are designed to transfer structural loads through the soft soils to more competent soil strata. Deep foundations are often relatively expensive when compared to other construction methods.

Another way to support such structures is to excavate out the soft, loose, or weak soils and then fill the excavation with more competent material. The entire area under the building foundation is normally excavated and replaced to the depth of the soft, loose, or weak soil. This method is advantageous because it is performed with conventional earthwork methods, but has the disadvantages of being costly when performed in urban areas and may require that costly dewatering or shoring be performed to stabilize the excavation.

Yet another way to support such structures is to treat the soil with "deep dynamic compaction" consisting of dropping a heavy weight on the ground surface. The weight is dropped from a sufficient height to cause a large compression wave to develop in the soil. The compression wave compacts the soil, provided the soil is of a sufficient gradation to be treatable. A variety of weight shapes are available to achieve compaction by this method, such as those described in U.S. Pat. No. 6,505,998. While deep dynamic compaction may be economical for certain sites, it has the disadvantage that it induces large waves as a result of the weight hitting the ground. These waves may be damaging to structures. The technique is deficient because it is only applicable to a small band of soil gradations (particle sizes) and is not suitable for materials with appreciable fine-sized particles. What is needed in the field is a system that can rapidly improve cohesionless, cohesive, and semi-cohesive soils without inducing damaging vibrations.

More recently, ground reinforcement with aggregate columns has been used to support structures located in areas containing layers of soft soils. The columns are designed to reinforce and strengthen the soft layers and reduce settlements. Such piers are constructed using a variety of methods including drilling and tamping methods such as described in U.S. Pat. Nos. 5,249,892 and 6,354,766 ("Short Aggregate Piers"), driven mandrel methods such as described in U.S. Pat. No. 6,425,713 ("Lateral Displacement Pier"), and tamping head driven mandrel methods such as described in U.S. Pat. No. 7,226,246 ("Impact®" system).

The "Short Aggregate Pier" technique referenced above, such as described in U.S. Pat. No. 5,249,892, which includes drilling or excavating a cavity, is an effective foundation solution, especially when installed in cohesive soils where the sidewall stability of the hole is easily maintained. The Short Aggregate Pier method may, theoretically, also be applied to multiple holes at once. However, this technique has the disadvantages of requiring casing in granular soils with collapsing holes and of necessitating the filling of the holes prior to tamping. When theoretically applied to multiple holes at once, the system is limited to very shallow treatment depths such as those needed for improvement below pavements. Needed in the field is a system that overcomes these deficiencies by allowing soil improvement to a wide range of soil conditions without the necessity of filling the holes between tamping passes and of being able to treat to deeper depths required for the support of shallow spread footings.

The "Lateral Displacement Pier" and "Impact®" system methods were developed for aggregate column installations in granular soils where the sidewall stability of the cavity is not easily maintained. The Lateral Displacement Pier is built as described in U.S. Pat. No. 6,425,713 by driving a pipe into the ground, drilling out the soil inside the pipe, filling the pipe with aggregate, and using the pipe to compact the aggregate "in thin lifts." A beveled edge is typically used at the bottom of the pipe for compaction. The Impact® system is an extension of the Lateral Displacement Pier. In this case, a smaller diameter (8 to 20 inches) tamper head is driven into the ground as disclosed in U.S. Pat. No. 7,226,246. The tamper head is attached to a pipe, which is filled with crushed stone once the tamper head is driven to the design depth. The tamper head is then lifted, thereby allowing stone to remain in the cavity, and then the tamper head is driven back down in order to densify each lift of aggregate. An advantage of the Impact® system, over the Lateral Displacement Pier, is the speed of construction.

The "Rampact®" system is yet another displacement method in which a single conical shaped mandrel is driven into the ground and then filled with crushed stone as described in U.S. Pat. No. 7,326,004. The mandrel is hollow and fitted with a sacrificial plate or a valve mechanism at the bottom. The mandrel is later lifted to allow the rock to flow out of the bottom of the mandrel. The mandrel is then redriven back down into the cavity to compact the stone. The pier is constructed incrementally upwards in thin lifts from the bottom.

SUMMARY OF THE INVENTION

The present invention is directed to an apparatus and method for ground improvement. In one embodiment, a device for ground improvement is provided and comprises a top plate having a first surface configured for having a driving device attached thereto to provide impact thereon; a plurality of vertically extending tines attached to a second surface of the top plate opposite the first surface of the top plate, and horizontally spaced from each other at upper lateral edges thereof, for being driven into a ground surface, wherein the tines comprise a length to spacing (L/S) ratio of greater than one (1); and the tines being shaped, spaced, and oriented relative to each other in a manner to achieve displacement of ground material downward and radially outward.

In an exemplary embodiment, the tines comprise a length to spacing (L/S) ration of approximately four (4). The tines can be tapered to be narrower at an end away from the top plate than at the attachment to the second surface of the top plate. The tines can be tapered at an angle in the range of 0° to 5°, and more specifically, at an angle in the range of 0.5° to 2.5°. The tines can have a length in the range of 2-30 feet, and more specifically, in the range of 6-20 feet. The tines can be circular in cross-section, or articulated in cross-section. The tines can be substantially flat at an end away from the top plate, substantially pointed at an end away from the top plate, or have a bulbous shape at an end away from the top plate. The tines can be made of ferrous material, steel, or composite materials. The tines can be hollow and have openings at the ends away from the top plate and respective valves at the openings for restricting entry of soil during advancement, and for allowing passage of flowable material outward during retraction. The hollow tines can also have openings at the ends away from the top plate, and respective sacrificial plates at the openings.

In one exemplary embodiment, the plurality of tines comprises five tines horizontally spaced from each other, with four perimeter tines spaced about the periphery of the top plate and surrounding a centrally located tine. The perimeter tines can be oriented at 45° about their vertical axis relative to the centrally located tine. In another exemplary embodiment, the plurality of tines comprises eleven tines horizontally spaced from each other, with eight perimeter tines spaced about the periphery of the top plate and surrounding three centrally located tines. The perimeter tines can be oriented at 45° about their vertical axis relative to the centrally located tines. In yet another exemplary embodiment, the plurality of tines comprises eight tines horizontally spaced from each other, with six perimeter tines spaced about the periphery of the top plate and surrounding two centrally located tines. The perimeter tines can be oriented at 45° about their vertical axis relative to the centrally located tines.

In another embodiment, a method for ground improvement is provided and comprises providing a device for ground improvement comprised of a top plate having a first surface configured for having a driving device attached thereto to provide impact thereon, and a plurality of vertically extending tines attached to a second surface of the top plate opposite the first surface of the top plate, and horizontally spaced from each other at upper lateral edges thereof, for being driven into a ground surface, wherein the tines comprise a length to spacing (L/S) ratio of greater than one (1), and the tines being shaped, spaced, and oriented relative to each other in a manner to achieve displacement of ground material downward and radially outward; advancing the device tines into the ground surface; retracting the tines from the ground surface; repeating the advancing and retracting until a desired ground condition is achieved.

In an exemplary embodiment, the advancing of the tines creates cavities at the location the tines are advanced, and the method further comprises adding backfill into the cavities and advancing and retracting the device repeatedly after the backfill has been added. The tines can be hollow and each have an opening at an end away from the surface plate, such that backfill can be added through the tines and out the opening of each tine upon retraction thereof. The tines can have respective valves at the open ends, and the method comprises keeping the valves closed upon advancement of the device and opening the valves upon retraction, and adding the backfill through the tines. The tines can also have respective sacrificial plates at the open ends, and the method comprises securing the sacrificial plates to the tines upon advancement of the device and allowing the sacrificial plates to separate from the tines upon retraction, and adding the backfill through the tines. The backfill can be one of or a combination of crushed stone, sand, aggregate, gravel, grout, concrete, lime, fly ash, waste materials, tire chips, recycled materials, and other flowable substances. The level of ground improvement achieved can be measured through a monitoring of downward pressure during penetration for a determination of degree of densification.

It is to be understood that the invention as described hereafter is not limited to the details of construction and arrangements of components set forth in the following description or illustrations in the drawings. The invention is capable of alternative embodiments and of being practiced or carried out in various ways. Specifically, the dimensions as described, and where they appear on the drawings are exemplary embodiments only and may be modified by those skilled in the art as conditions warrant.

DETAILED DESCRIPTION OF THE INVENTION

Figure 1:
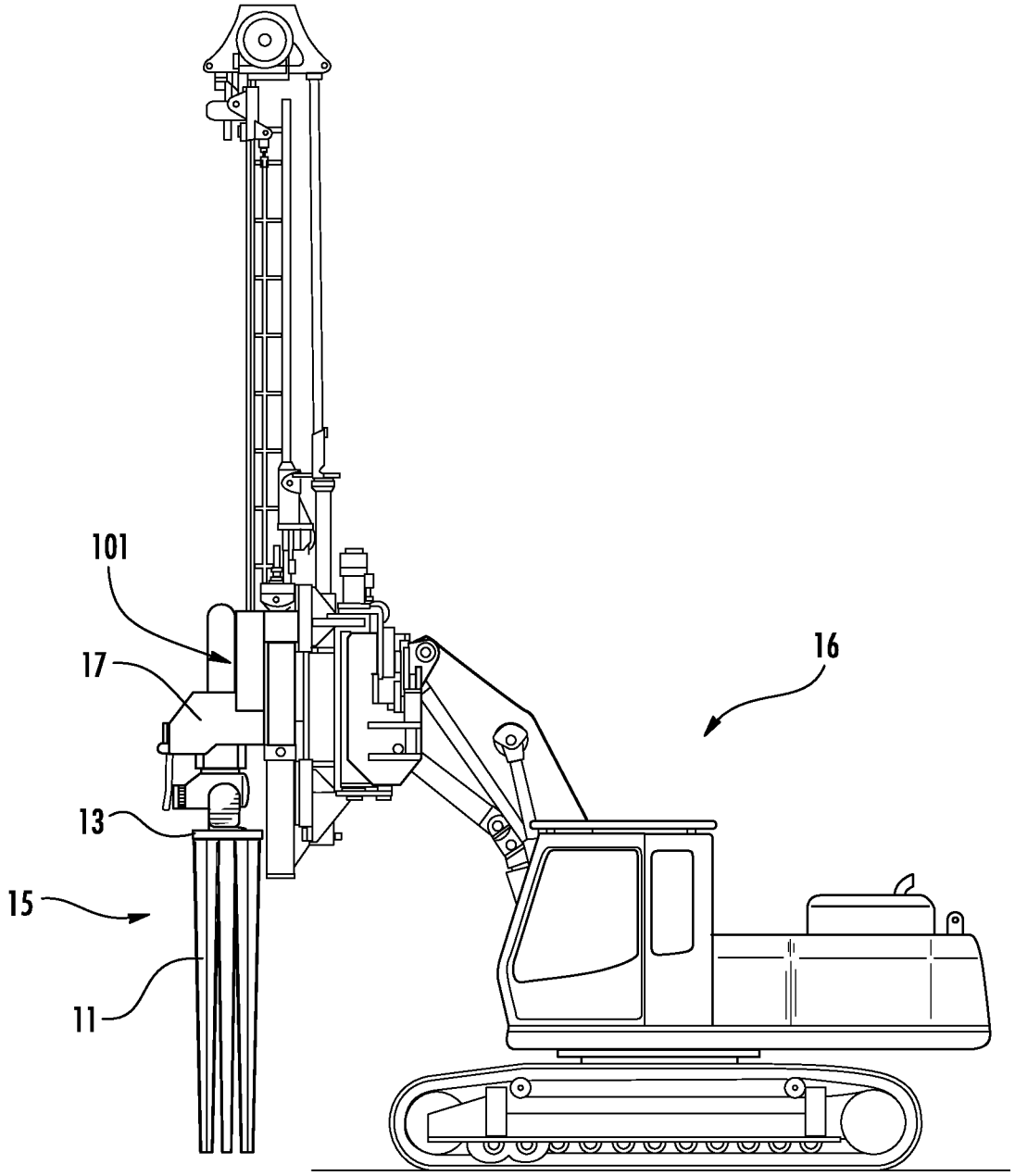
FIG. 1 is a drawing illustrating a system employing the device of the present invention.

According to the figures, the invention includes an apparatus and method for improving the strength and stiffness of in-situ subsurface materials, e.g., soil in a grounded surface, prior to loading by buildings, slabs, walls, tanks, transportation structures, industrial works, and other structures. The apparatus includes a device 15 made up of a series of vertically oriented tines 11 which extend downwardly and are fixed to a top plate 13. The purpose of the top plate 13 is to hold the tines 11 in place. The top plate 13 holds the tines together and does not necessarily provide densification or confinement during densification.

As shown in FIGS. 1, 2A, 2B, 3A, 3B, 4A, and 4B the tines 11 (including central tines 19) are affixed to the top plate 13, with welds or other means, to achieve a mechanical attachment connection. The tines 11 are horizontally spaced from each other at the attachment connection on top plate 13, and have a tine length to spacing (L/S) ratio of greater than one (1) wherein length (L) is the length of the tines and spacing (S) is typically the spacing between the tines on a tine center-to-center basis. The tine L/S ratio of greater than one (1) forms a boundary condition that restricts horizontal soil movement at the midpoints between adjacent tines during insertion and cavity expansion.

Figure 2A:
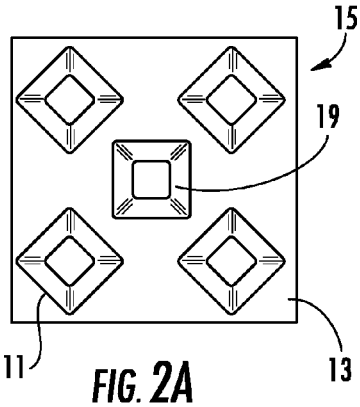
FIGS. 2A and 2B are plan and profile views of the device, respectively, illustrating the tines and top plate configuration in accordance with one embodiment of the present invention.

In FIG. 2A, the embodiment of the top plate 13 is square with dimensions of about 30 inches on each side, and is typically three inches thick. The top plate 13 may be made of steel. In other embodiments, the top plate 13 could be made of other materials such as iron, concrete, or composite materials. The dimensions of the top plate 13 are selected as those appropriate to hold the tines 11 in a vertical arrangement. In an alternate embodiment, shown in FIG. 3A, the top plate 13 is rectangular with dimensions of about 30 inches wide by about 60 inches long. As shown in the embodiment in FIG. 4A, the top plate 13 is rectangular with dimensions of about 30 inches wide by about 45 inches long. The precise dimensions of the top plate 13 are selected depending on the tine arrangement desired.

Each tine 11 extends vertically downward from the top plate 13. As shown in the embodiment shown in FIGS. 1 and 2B (and described in the Examples below), the tines 11 are typically five inches square at the bottom transitioning to eight inches square at the top, and extend a length of about six feet below the bottom of top plate 13 (a taper angle of approximately 2.4°). In this embodiment, the tines 11 are tapered to facilitate easy driving and extraction. The tapered shape also serves to confine the soil vertically from upward heaving. The degree of taper angle may vary but is contemplated to typically be in the range of 0 to 5°, and preferably 0.5° to 2.5°. While these angle ranges are for illustrative purposes, it is understood that other angle ranges could be used in order to achieve displacement of soil downward and radially outward to rigidify vertical soil boundaries between adjacent tines during the densification process. While the present invention contemplates a tine length to spacing (L/S) ratio of greater than one (1), the particular tine layout of this embodiment would comprise a tine length to spacing (L/S) ratio of approximately four (4) wherein length (L) is the length of the tines and spacing (S) is typically the spacing between the tines on a tine center-to-center basis.

While other dimensions are possible, the embodiment associated with FIG. 3B (and described in the Examples below) contemplates tines 11 typically four inches square at the bottom transitioning to eight inches square at the top, and extending a length of about 10 feet below the bottom of top plate 13 (a taper angle of approximately 1.9°). The embodiment associated with FIG. 4B (and described in the Examples below) contemplates tines 11 typically four inches square at the bottom (which is 20 feet below the top plate) transitioning to eight inches square at a distance of 10 feet below the top plate and remaining 8 inches square from the mid-height to the top plate 13 (or the taper may be consistent from the bottom to the top, with an appropriate change in geometry or taper angle).

Along with the tine length to spacing ratio described herein, the large length to width ratios of each individual tine 11 of the present invention is important to ensure adequate densification to design depths for spread footings (as opposed to shallow treatment depths such as those needed for improvement below pavements, as taught in the prior art). For example, the tines associated with FIGS. 2A and 2B (tine length of six feet and transitioning from five inches wide at the bottom to eight inches wide at the top) would have a length to width ratio ranging from 9 to 14.5 (measured from the top width and the bottom width, respectively). The tines associated with FIGS. 3A and 3B (tine length of 10 feet and transitioning from four inches wide at the bottom to eight inches wide at the top) would have a length to width ratio ranging from 15 to 30 (measured from the top width and the bottom width, respectively). The tines associated with FIGS. 4A and 4B (tine length of 20 feet and transitioning from four inches wide at the bottom to eight inches wide at the top) would have a length to width ratio ranging from 30 to 60 (measured from the top width and the bottom width, respectively).

Figure 5A:
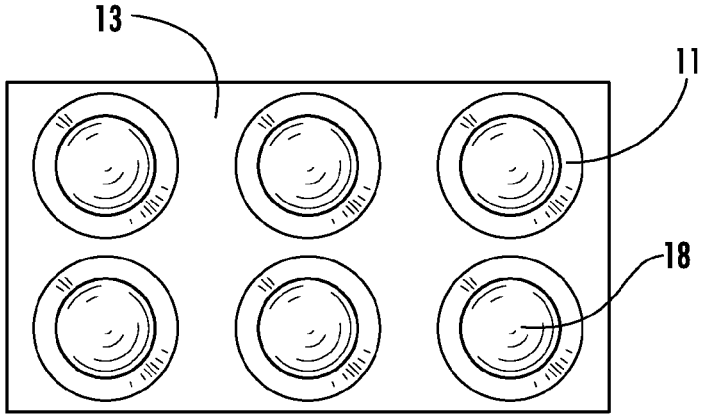
FIGS. 5A and 5B are plan and profile views, respectively, of one embodiment showing an expanded bulb at the bottom of the tines.
Figure 5B:
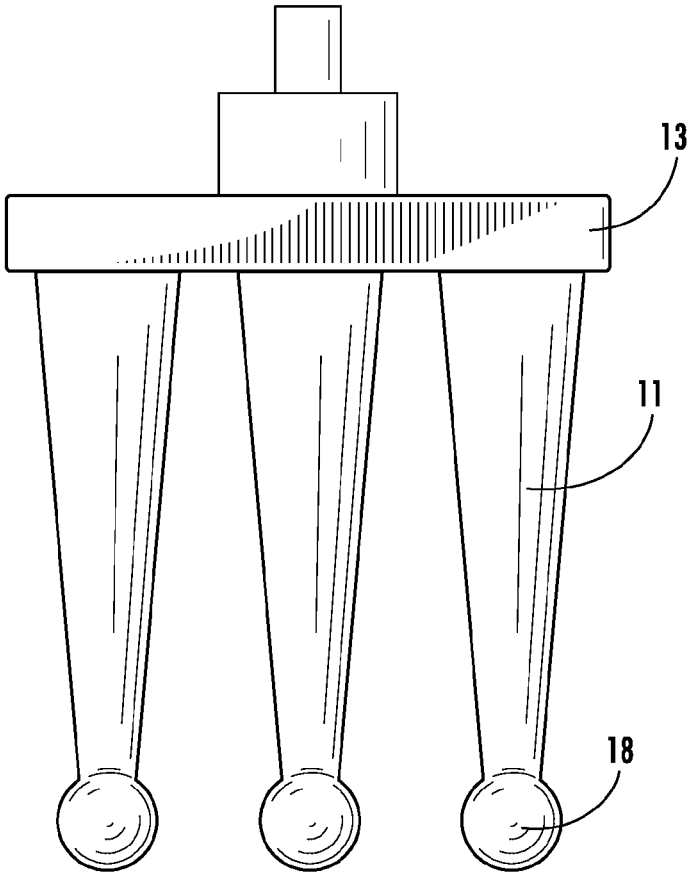

In an alternative embodiment, the tines may be cylindrical. In yet another embodiment, the tines 11 may be alternatively tapered or cylindrical. In a further embodiment, the tines 11 may have a bulbous bottom head 18 for additional densification as shown in FIGS. 5A and 5B. In cross section, the tines 11 may be circular or may be articulated, such as octagonal, hexagonal, square, triangular, or another articulated or semi-articulated shape.

The tines 11 are typically made of steel, cast iron, other ferrous metal, or composite materials and are typically hollow (thereby contributing to the relatively lightweight nature of the device). The tines 11 and top plate 13 making up the device 15 should be both strong and lightweight for easy driving. The device 15 is driven into the ground or soil by a mechanical driving apparatus or hammer 17 as shown in FIG. 1. Accordingly, it is important that the device be constructed in a manner that is relatively lightweight to facilitate driving. Typical weights for the device 15 can range from 1000 to 5000 pounds. This is in contrast to the prior art, particularly the "deep dynamic compaction" devices previously discussed, which must be heavily weighted for proper functioning.

As shown in FIG. 1, the device 15 is driven into the ground using the driving apparatus 17 which can include a high-frequency piling hammer attached to a machine such as an excavator 16. In one embodiment, the hammer may be a vibratory hammer typically used for sheet pile driving. In another embodiment, the hammer may be a drop hammer or a diesel or air hammer such as used to drive driven displacement piles. Other impact devices, vibratory or nonvibratory, are also envisioned.

The top plate 13 can include a grab plate (not shown) at the surface thereof facing the driving apparatus 17. The grab plate is conventional in nature and allows the top plate 13 to be attached to the driving device 17. The driving of the tines 11 is performed in a smooth, vibrating or hammering manner. This is in contrast to "deep dynamic compaction" devices previously discussed which require dropping a heavily weighted device from a relatively great height at intermittent intervals required for the lifting of heavy weights.

A sensor device may optionally be used for measurement of the degree of densification during the process. A sensor 101 may be attached to the driving device 17 above the top plate 13 of the multi-tined device 15 (such as, for example, at a location on a hammer sled). The sensor would enable measurement of applied downward "crowd" pressure during the densification process. The sensor could consist of a pressure gage mounted on the hydraulic lines of the rig, a strain gage mounted on the hammer sled or pull down cable, or an instrumented pin that measures shear force applied to a connection. The sensor would serve as an indicator of when the design densification level has been reached.

Figure 6A:
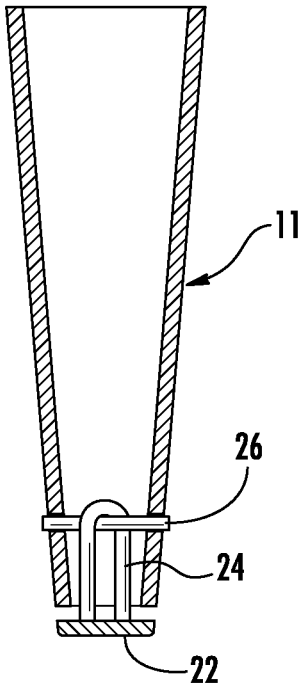
FIGS. 6A and 6B are profile views showing valves that can be positioned in the bottom portion of a single tine.
Figure 6B:
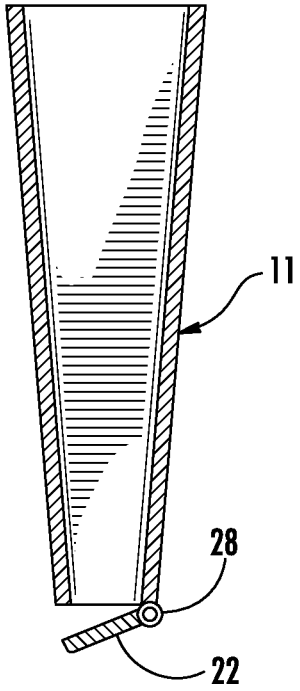
Figure 7:
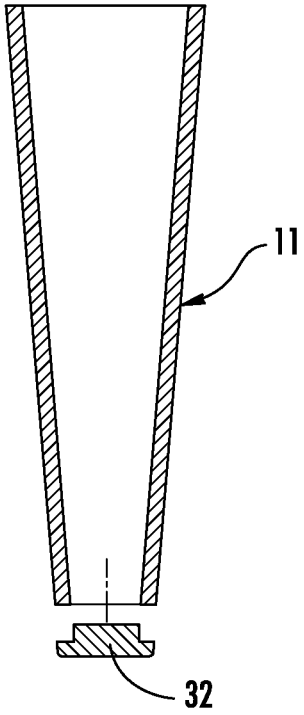
FIG. 7 is a profile view showing a sacrificial cap at the bottom of a single tine.

In another embodiment, the tines 11 are used as conduits for the placement of flowable fill such as grout or other flowable substance. In this embodiment, the tips of the tines 11 may be fitted with mechanical valves, such as shown in FIGS. 6A and 6B, to prevent the inward intrusion of soil below the tines during penetration and to allow the outward flow of backfill through the tines during extraction. Backfill materials may consist of fluid mixtures such as grout, concrete, and other self binding and hardening fluids or may consist of mixes of sand, cement, flyash, and other admixtures. Valves may consist of portals such as shown in FIG. 6A wherein a flat plate 22 is secured by, for example, a wire rope or U-bolt 24 over a pin 26 that spans between walls of the tine 11. Valves may also consist of mechanical doors such as the hinged valve shown in FIG. 6B which consists of a flat plate 22 hingedly attached to the body of the tine 11 by a hinge 28. The operation of any envisioned valve would allow the valve to remained closed (to prevent soil intrusion) as the tines are being inserted into the ground surface (due to upward force from the ground keeping the valve/hinge closed tight against the body of the tine) and as the tines are lifted up, the downward movement of the fill material will cause the valve to open to allow the fill material to flow from within the tines. Optionally, sacrificial plates, such as plate 32 at the bottom of tine 11 shown in FIG. 7 may be used in lieu of valves and would function the same way operationally.

As will be shown subsequently, the device 15 facilitates soil improvement to a depth greater than the furthest extension of the tines 11 in the soil. This is significant because the invention provides a means to treat the soil to depths much greater than provided by other means.

A method in accordance with the invention involves driving the device 15 and its tines 11 into the ground to a depth of desired improvement. The driving takes place as quickly as possible in one smooth motion facilitated by vibratory or impact energy such as that achieved by hammering. The device is then retracted from the ground to the ground surface. During retraction, the sidewalls of formed holes may collapse if the matrix soil is in a very loose state. This collapse manifests itself into settlement of the ground surface in the area of ground improvement by the device 15. The device 15 and its tines 11 may be then reinserted into the ground to the depth desired, and then once again retracted. The process of penetration and retraction serves to achieve densification through the displacement of the ground material downward and radially outward.

For some soil profiles, after the ground is treated with the device, the ground may "tighten up" and the holes formed by the tines 11 may stay open. Optionally, these holes may be filled with flowable material, such as, for example, crushed limestone, sand, aggregate, gravel, granular waste products, tire chips, concrete, grout, fly ash, lime, cement, recycled materials (concrete, glass, etc.), or other flowable material. The purpose of the backfill is to prevent the holes from collapsing at a later time. The area of improvement may then be once again improved by re-inserting the device 15 and its tines 11, or it may be considered to be fully treated, depending on design requirements.

The presence of the plurality of vertical tines 11 serves an important function for the device 15. As each tine 11 is inserted, the soil in the area of the tines 11 is displaced both downward and radially outward. The radial outward displacement is called cavity expansion. During tine 11 insertion, cavity expansion causes the soil around the tine 11 to displace outward and compact. The degree of densification depends on the ability of the soil to drain and compact, on the degree of cavity expansion, and on the boundary conditions surrounding the cavity.

The more rigid the boundary surrounding the expanded cavity, the greater the densification. In contrast, for a unitary or single tine device, i.e., single probes, the boundary of an expanded cavity at any radius from the edge of the cavity consists of soil that itself may further deform outwardly away from the single tine. This non-rigid boundary lessens the amount of potential densification because it provides little lateral restraint. For the present invention, the boundary of the expanded cavity around each tine 11 is characterized in part by the presence of, and interaction with, adjacent tines 11, that are also causing cavity expansion. Thus, the cavity expansion of each tine 11 is contained by an adjacent expanding cavity that is being expanded in the opposite direction. These equal and opposite forces effectively form a rigid vertical boundary condition or sidewall during insertion and cavity expansion. The result is a very efficient soil improvement method that leads to greater densification. This is because the tines are spaced from each other at all locations, including being horizontally spaced from each other at the respective attachment locations at the top plate.

The method described herein (and in the Examples below) contemplates various steps including multiple passes then filling; filling after each pass; never filling in soils that collapse; surface tamping later; filling with sand; filling with crushed stone; filling with other aggregate; filling with gravel; filling with granular media such as glass, recycled materials, or others; filling with tire chips; filling with a fluid media such as grout or concrete; filling with mixtures of sand, water, fly ash, and cement; or using two tines, three tines, four tines, five tines, or additional tines, as may appropriate to the site.

Having generally described the invention, it is more specifically described by illustration in the following specific Examples which describe different embodiments with respective different numbers and shapes of tines employed.

Example I

In May of 2009, testing was performed using a first embodiment of the invention at an Iowa Test Site. The device was used to stabilize natural sand, natural silty sand, and imported fill sand at the site. The device 15 of the invention was advanced at a total of 36 locations. The device 15 was advanced to a depth of 6 feet in all cases. This testing program was used to evaluate the quantitative improvements using the device 15, in comparison to surface compaction with a vibratory plate applied at the ground surface.

Installations

Figure 2B:
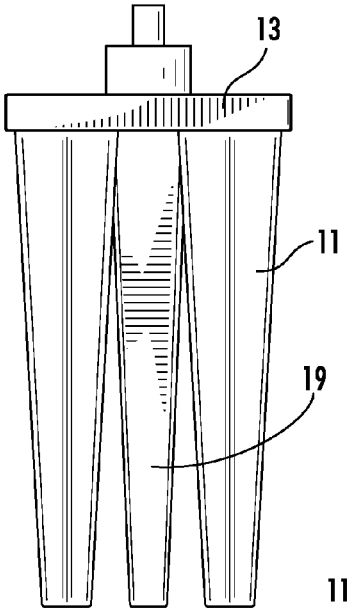

The device used in this Example I was fabricated to reflect the features shown in FIGS. 2A and 2B. In accordance with the device shown in the figures, five 6-foot long tines 11 were welded to a top plate 13. The tines 11 were fabricated using a square cross-sectional shape tapered upward from a width of 5 inches at the bottom of the tines, to a width of 8 inches at the top of the tines 11. The tines 11 were welded to a 30-inch square top plate 13. The tines 11 at the perimeter or periphery of the plate 13 were oriented 45 degrees relative to a central tine 19 to reduce the potential for plugging of soil/sand between adjacent tines. A grab plate (not shown), as previously discussed, was attached to the upper surface of the plate 13. A high frequency hammer that is often used for driving sheet piles was used to advance the device 15 into the soil. The hammer was attached to the device 15 by clamping to the grab plate.

The Test Site contained approximately 4 feet of natural silty sand over natural clean sand. Standard Penetration Test ("SPT") N-values in the upper 10 feet generally ranged between 5 and 10 blows per foot. Groundwater was noted at a depth of 6 to 8 feet during the post-installation Cone Penetration Test ("CPT") measurements.

Prior to testing, in an approximately 20-foot by 20-foot area, the upper 4 feet of silty sand overburden was removed and replaced with uncompacted sand. Testing was performed both in this area, and to the outside of this area where the silty sand overburden remained in place. The test areas were improved by the device 15.

Figure 8:
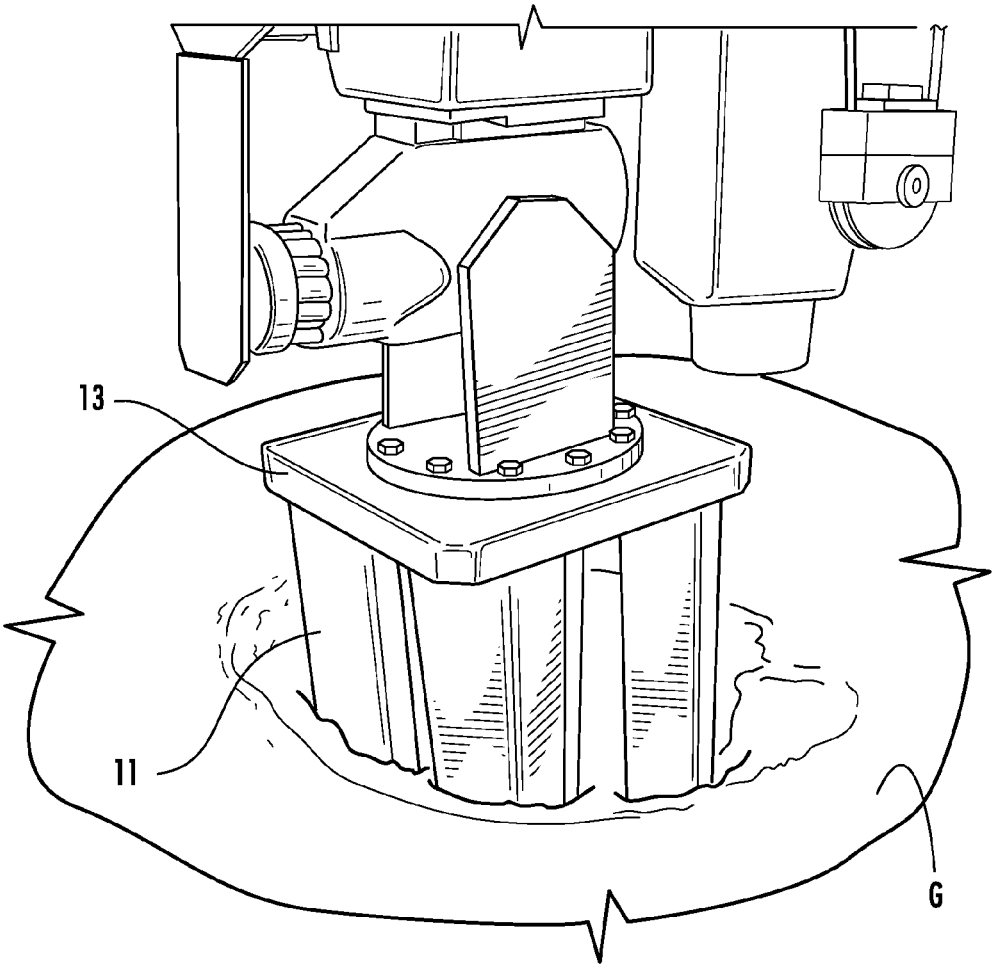
FIG. 8 is a perspective illustration of the device of FIG. 1 during driving to achieve densification.
Figure 9:
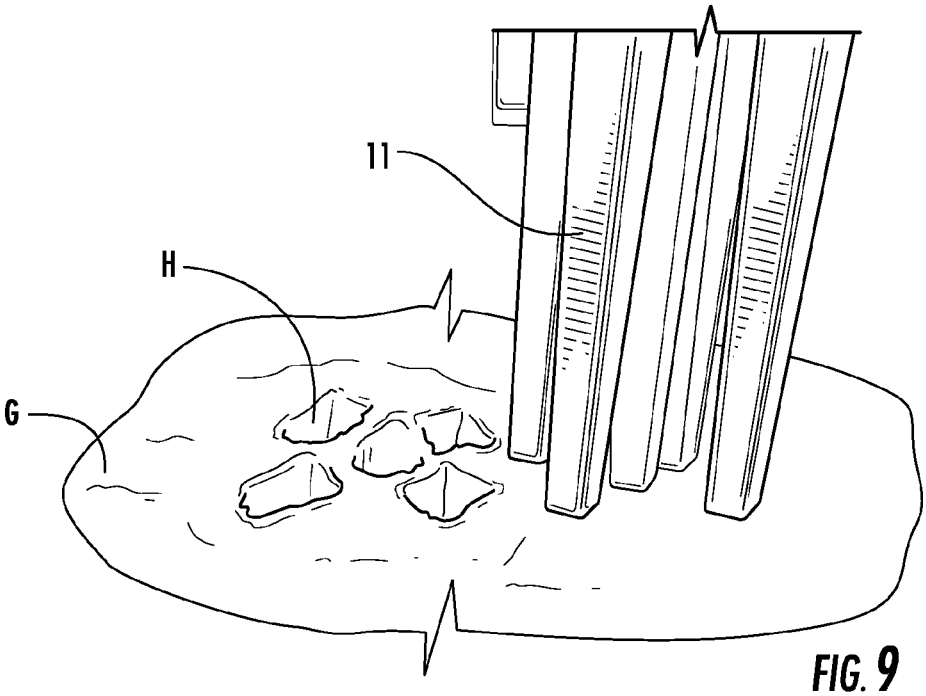
FIG. 9 is an illustration showing cavities or holes that are formed by the device of the present invention, after removal of the device from the ground.
Figure 10:
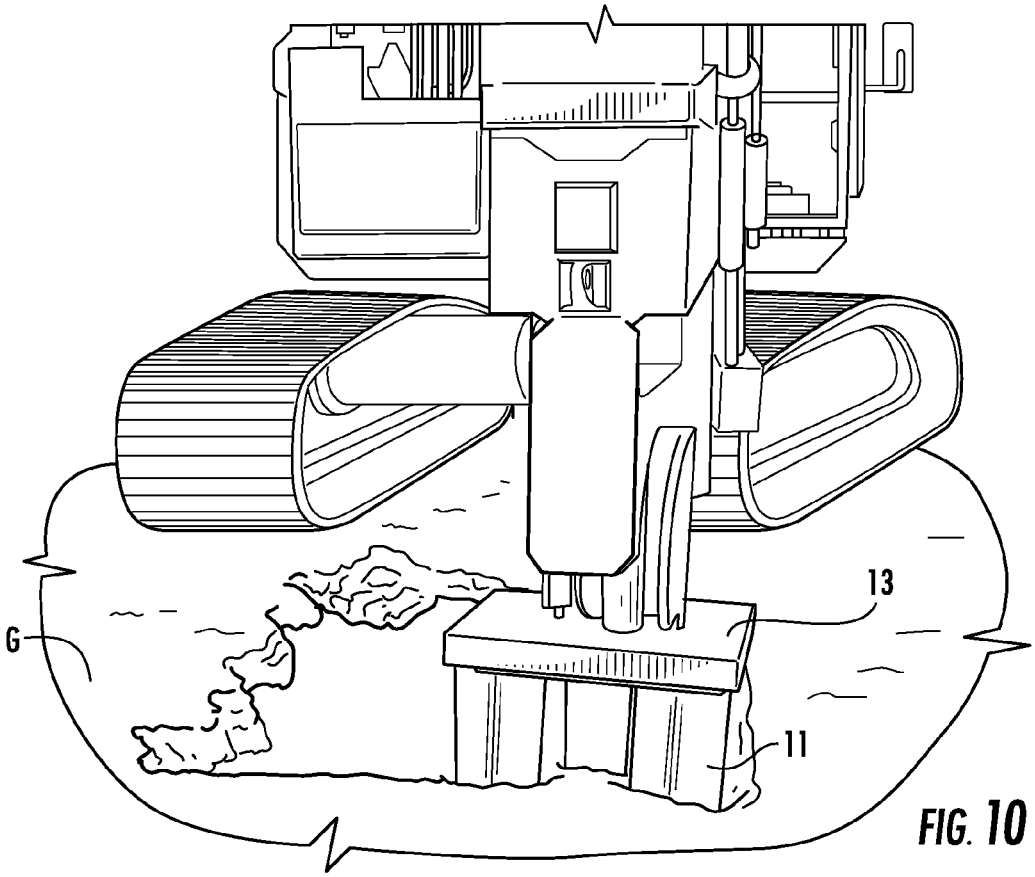
FIG. 10 is an illustration showing a ground surface as the device of the present invention is treating the soil, and illustrating surface settlement that occurs when the soil is densified.

Referring to FIGS. 8 through 10, at 9 locations (Locations 1-9) within the sand area, the device 15 and tines 11 were advanced and retracted three times at the same location. Each cycle of penetration and extraction is called a "pass". Then sand was added to fill the depressed area back up to the adjacent ground surface. This process of three advancements and retractions (three passes) followed by fill was repeated three more times for a total of twelve passes per location. The first two times about one cubic yard of sand was added. After that, lesser amounts of sand were needed as the ground G was densified. It typically took 10 minutes for the 12 passes for each location. The individual cavities or holes H remained open after six passes (see FIG. 9).

For a second 9 locations (Locations 10-18) in an area containing natural silty sand overlying natural sand, the same procedure was used as with the first 9 locations (Locations 1-9), although less sand was needed to fill the depressed areas. This is assumed to be caused by the upper 4 feet of sand backfill being looser at the first 9 locations (Locations 1-9) than the second 9 locations (Locations 10-18).

To increase the speed of installation from 10 minutes to 3 minutes per location, the procedure was then changed, as described below. At a third 9 locations (Locations 19-27) within the imported sand area, a total of three passes were made at each location as compared to 12 made for the first 18 locations (Locations 1-9 and Locations 10-18). Crushed stone was added to fill the depression area after each pass. This same process was performed at a fourth 9 locations (Locations 28-36) in the natural silty sand soil area.

To provide a comparison with the four installations described above, within approximately 10-foot by 10-foot areas in both the imported sand area and natural silty sand overburden area, the ground surface was compacted with a conventional vibrating plate compactor applied to the ground surface. There were also test sites in both the sand area and natural silty sand overburden area with no improvement of any type (with the vibrating plate or with the present invention) in order to establish initial unimproved (base line) conditions.

CPT Testing

Figure 11:
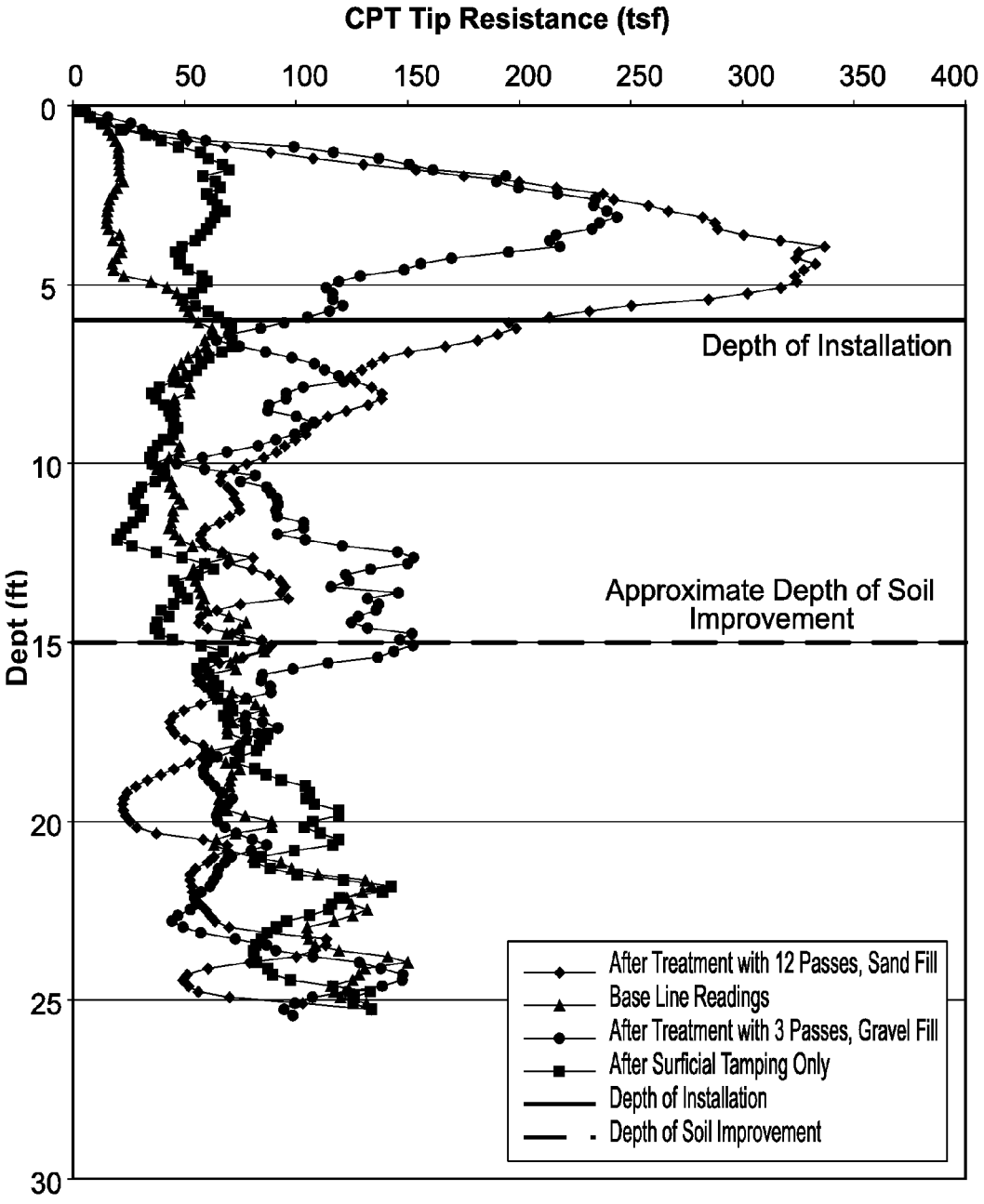
FIG. 11 is a graph illustrating the Cone Penetration Test ("CPT") tip resistance results in an imported sand site after treatment with a 6 foot long device.
Figure 12:
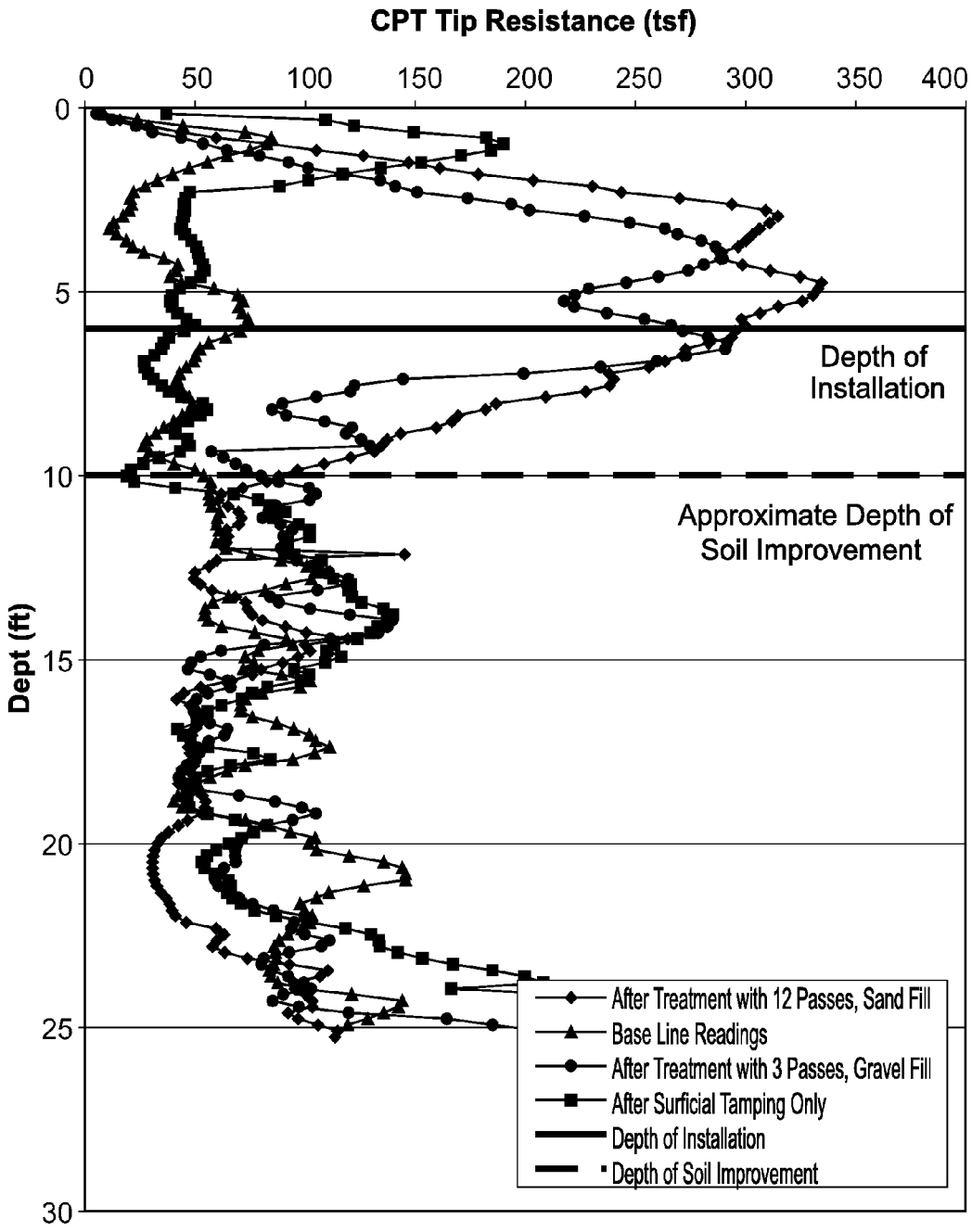
FIG. 12 is a graph illustrating the CPT tip resistance results in a natural silty sand site after treatment with a 6 foot long device.

Cone Penetration Tests ("CPT") were performed at the 36 treated locations described above (and the vibrating plate sites and base line sites) after the installations to quantify the improvements that were achieved. The CPT results are shown in FIGS. 11 and 12. FIG. 11 illustrates the CPT tip resistances at the imported sand site. FIG. 12 illustrates the CPT tip resistances at the natural silty sand site.

For the imported sand site (FIG. 11), the base line (no improvement) readings show that CPT tip resistances are approximately 20 tons per square foot ("tsf") in the zone of the imported sand fill (depth of 4 feet) and approximately 50 tsf below. Surface compaction with vibrating plate only showed improvement to a depth of about 5 feet, increasing the CPT tip resistances from about 20 tsf (base line) to 50 tsf (after treatment with vibrating plate only). Treatment with three (3) passes of the device and backfilling with crushed stone gravel improved the soil up to a depth of about 17 feet; CPT tip resistances increased up to 250 tsf at a depth of 3 feet and ranged between about 50 tsf and 150 tsf below. Treatment with 12 passes and backfilling with sand improved the soil to a depth of about 14 feet; the CPT tip resistances generally peaked at about 340 tsf at a depth of 3 feet and ranged between 70 tsf and 200 tsf below.

For the natural silty sand site (FIG. 12), the baseline CPT tip resistances ranged between 20 tsf and 80 tsf. Superficial compaction with vibrating plate only showed improvement to a depth of about 3 feet to 5 feet, increasing the CPT tip resistances up to 175 tsf at a depth of 1 foot and up to 50 tsf below. Treating the site with 3 passes backfilled with stone gravel improved the soil to a depth of about 13 feet; CPT tip resistances increased to 275 tsf at depths of 4 to 7 feet and ranged between 70 tsf and 150 tsf below. Treating the site with 12 passes backfilled with sand improved the site to a depth of about 11 feet; CPT tip resistances increased to more than 300 tsf at depths of 3 to 5 feet and ranged from 70 to 150 tsf below.

The soil improvement using the device of the present invention applied to both the imported sand backfill and natural silty sand over clean sand sites showed 5- to 7-fold increases in CPT tip resistances over the depth of tine penetration. The soils below the maximum penetration of the tines showed 1.5- to 3-fold increases in CPT tip resistances to depths of twice the width of the top plate extending below the maximum tine penetration depth.

In consideration of the results achieved and a comparison of the installation times for the two procedures, it appears that treatment with three passes achieves almost the same results as treatment with 12 passes and is thus deemed to be more efficient.

Example II

In July of 2009, additional installations and testing were performed at the Iowa Test Site as described in Example I above. An alternate embodiment of the device 15 was advanced at a total of 22 locations, as described below. The device was advanced to a depth of 10 feet in all cases.

Installations

Figure 3A:
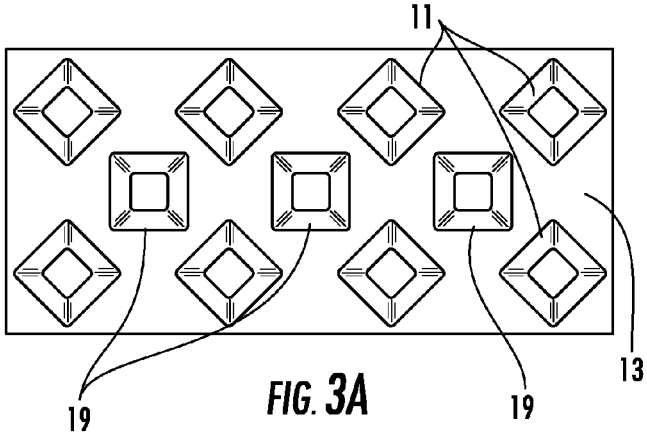
FIGS. 3A and 3B are plan and profile views of the device, respectively, illustrating the tines and top plate configuration in accordance with another embodiment of the present invention.
Figure 3B:
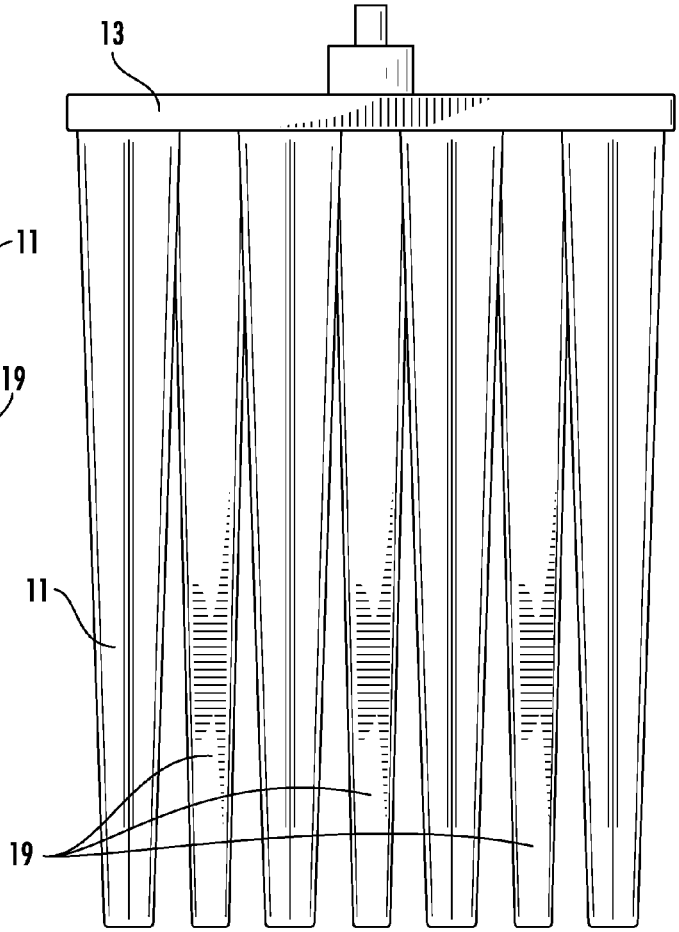

The embodiment used in this Example II is shown in FIGS. 3A and 3B and is a device having eleven individual tines 11 attached to an approximately 30-inch by 60-inch top plate 13, with eight tines 11 spaced from each other along the periphery of the top plate 13 and three central tines 19 spaced from each other in an interior region of top plate 13. As in the previous example, a grab plate (not shown) was welded to the top plate, allowing use with a vibratory hammer (amongst others). Each of the tines was 10 feet long, with a 4-inch by 4-inch square bottom transitioning to an 8-inch by 8-inch square top where they connected to the top plate 13. The perimeter or periphery tines 11 were oriented 45 degrees to the central tines 19 to reduce the potential for plugging of soil/sand between adjacent tines 11 (including central tines 19).

The installations with the embodiment of this example included four passes (insert tines, then retract and backfill holes in subsided area) and 12 passes in the imported sand site, and four passes and six passes in the natural silty sand site. For the installations using the embodiment of this example, sand backfill was used in all cases. The subsided area was filled with about 5 to 7 cubic yards of sand for each location. The treatment took about 2 minutes per pass. After the passes were completed the ground surface was surface compacted with a vibratory plate.

CPT Testing

CPT tests were performed within the footprint of the improved area to quantify the improvement that was achieved. There was also base line readings performed in untreated areas.

Figure 13:
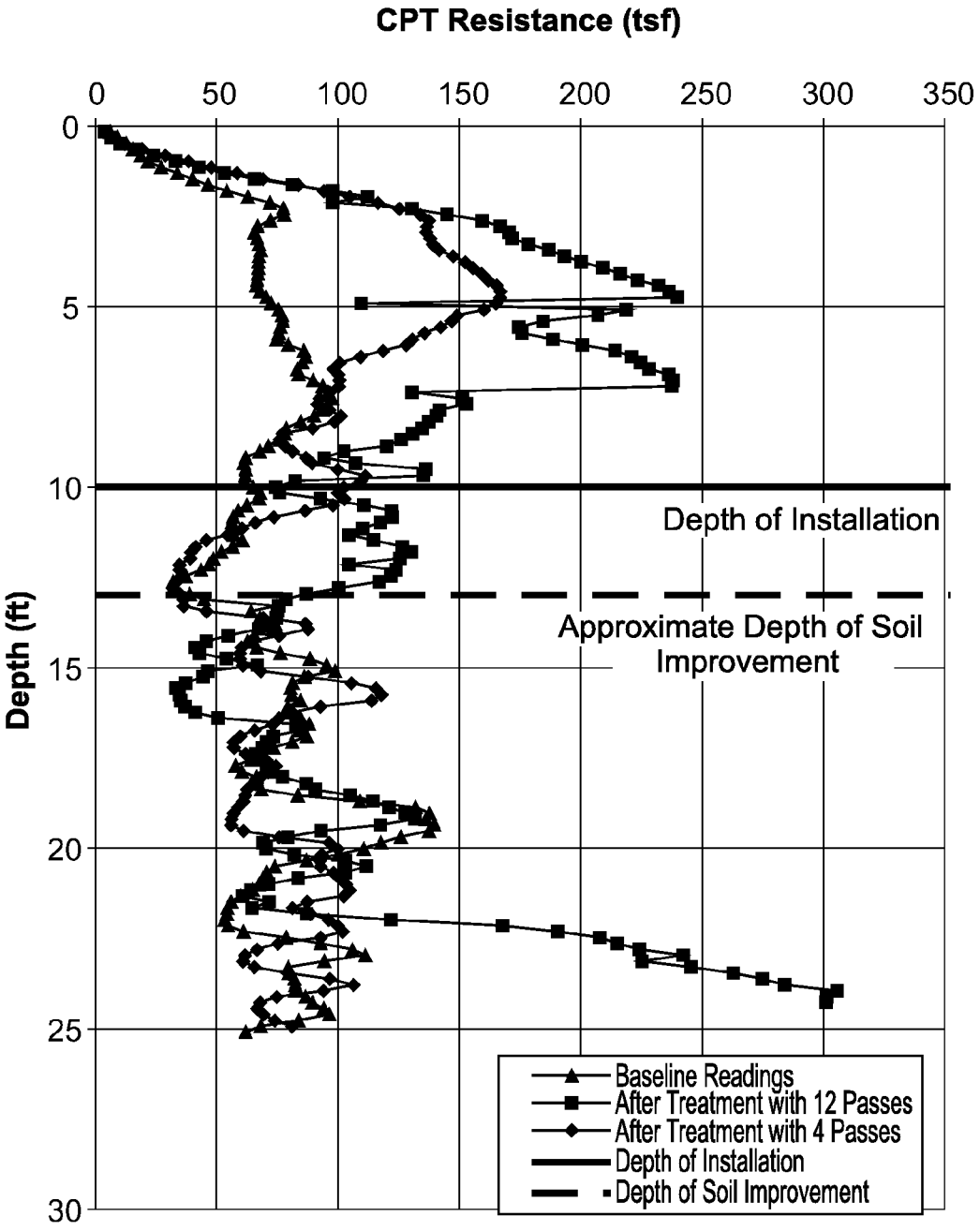
FIGS. 13 and 14 are graphs illustrating CPT tip resistance results in an imported sand site and in a natural silty sand site, respectively, after treatment with a 10 foot long device.
Figure 14:
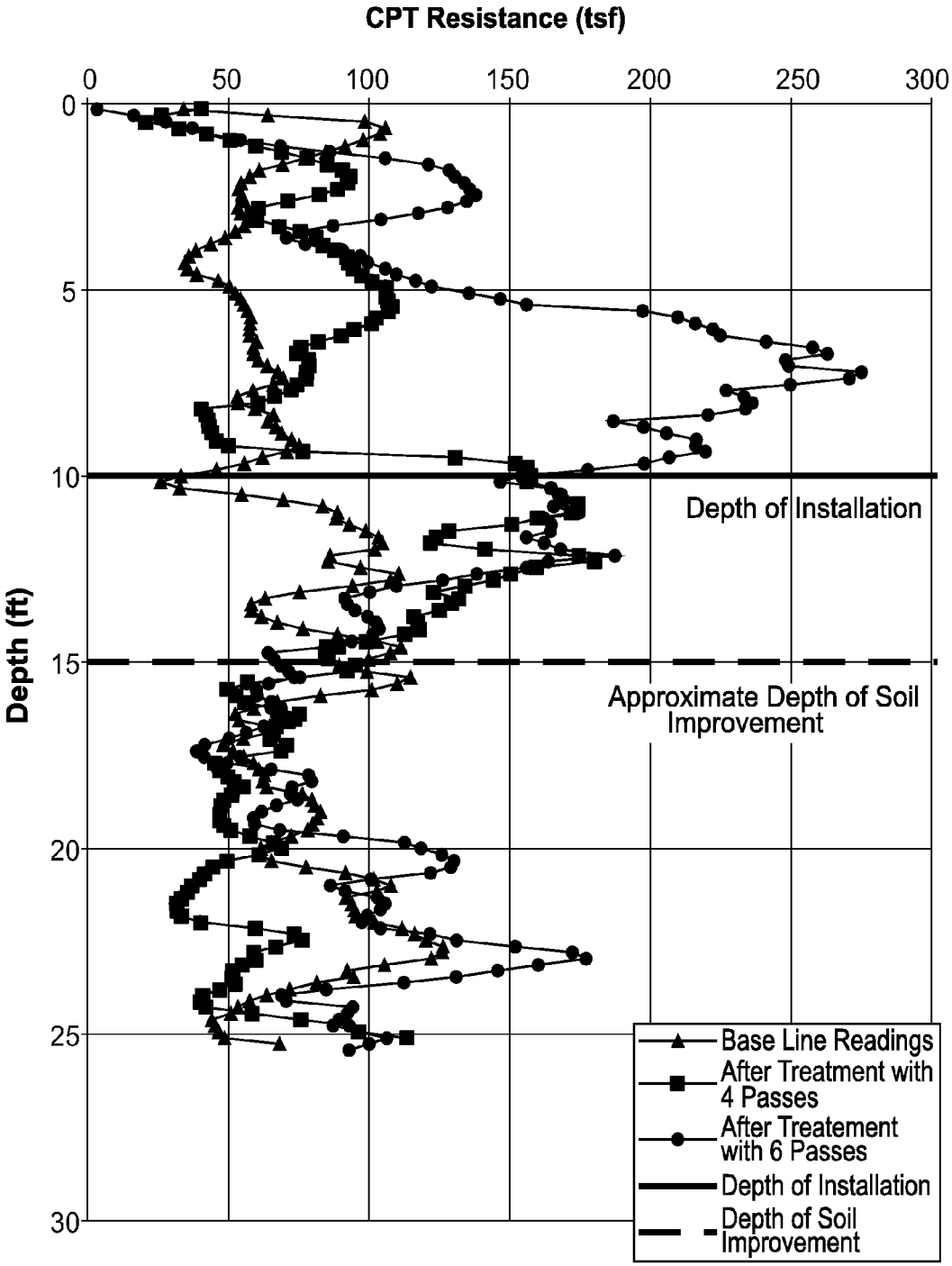

A summary of the CPT results performed are presented in FIGS. 13 and 14. FIG. 13 shows the CPT tip resistances in the imported sand site and FIG. 14 shows the CPT tip resistances for the natural silty sand site.

For the imported sand site (FIG. 13) the baseline CPT tip resistances generally ranged between 50 tsf and 100 tsf throughout the upper 15 feet of the soil profile. After treatment with four passes, the CPT tip resistances increased up to about 170 tsf to a depth of 5 feet, and ranged between 50 tsf and 150 tsf from 5 feet to 10 feet. Below a depth of 10 feet, the CPT tip resistance ranged between about 30 tsf and 120 tsf. After treatment with 12 passes, the CPT tip resistances showed substantially more improvement; the tip resistances increased to values up to 240 tsf at depths of 5 feet and 7 feet; and values generally ranging between 100 tsf and 150 tsf from 7 feet to 13 feet which appeared to be the depth of soil improvement.

For the natural silty sand site (FIG. 14), the baseline CPT tip resistances generally ranged between 40 tsf and 70 tsf to a depth of 10 feet and generally ranged between 60 tsf and 110 tsf from 10 to 15 feet. After treatment with four passes, the CPT tip resistance values increased to values of up to 100 tsf in the upper 10 feet and exceeding 150 tsf from 10 feet to 12 feet. The tip resistances ranged between 100 tsf and 150 tsf from depths of 12 feet to 15 feet. After treatment with six passes, the CPT tip resistances showed substantial improvement with tip resistance values of up to 270 tsf to depths of 10 feet and ranging between 100 tsf and 180 tsf from 10 feet to 15 feet.

The test results made after installations with the 10 foot long device 15 showed significant improvements throughout the depth of device penetration and further soil improvements to about twice the width of the top plate (13) of the device extending below the maximum penetration depth. The degree of soil improvement increases with the number of passes.

The device was fabricated to increase the tine length to 20 feet for a separate embodiment as described below.

Example III

In November of 2009, additional testing was performed at the Iowa Test Site as described in Example I above. A new embodiment of the invention was advanced at a total of 10 locations, as described below. The device 15 was advanced to a depth of 20 feet in all cases, unless refusal was encountered. The intention of this testing program was to evaluate the quantitative improvements using the new embodiment.

Installations

Figure 4A:
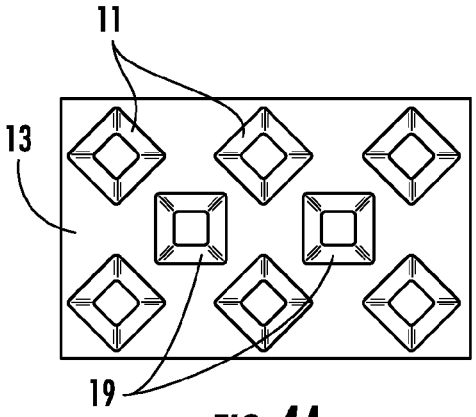
FIGS. 4A and 4B are plan and profile views of the device, respectively, illustrating the tines and top plate configuration in accordance with yet another embodiment of the present invention.
Figure 4B:
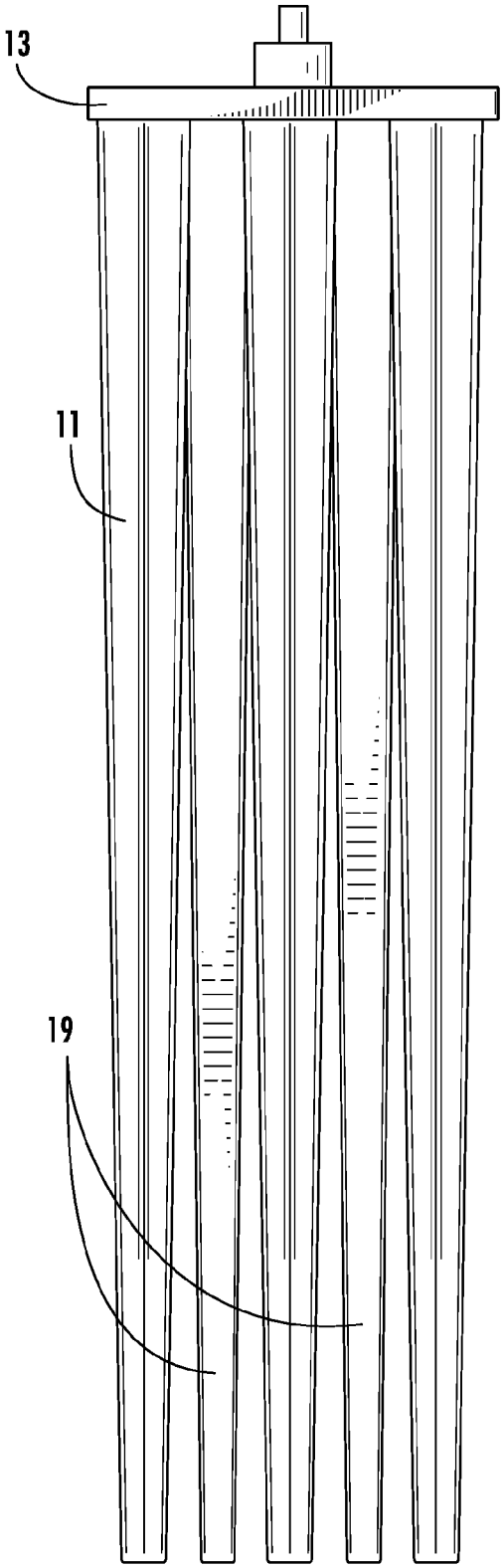

The new embodiment in this Example III was a device 15 including eight individual tines 11 attached to an approximately 30-inch by 45-inch top plate 13 as shown in FIGS. 4A and 4B. The individual tines 11 were each 20 feet long, with a 4-inch by 4-inch square bottom transitioning to an 8-inch by 8-inch square top where they connect to the top plate 13. The transition was accomplished approximately half-way up the tine length. A grab plate was welded to the top plate, allowing use with a vibratory hammer.

For all of the embodiments, the perimeter tines 11 were oriented 45 degrees to any central tines 19 to reduce the potential for plugging of soil/sand between adjacent tines 11.

Testing was performed in the area that was characterized by natural silty sand over natural clean sand. Results discussed below were based on treatments consisting of four passes and one pass.

During installation at locations 1-4, significant surface depression was noted, as further evidenced by the amount of backfill that was used. Additionally, a series of radial tension cracks were noted around this area. The first cracks were noted about 8 feet from the center of the installation. At the time of completion, the furthest cracks were about 18 feet from the center, representing a circular affected area with a diameter of about 36 feet.

Surface compaction was performed after installations with the embodiment of this example and prior to CPT testing.

CPT Testing

CPT testing was performed at the locations tested to quantify the improvement that was achieved. The first CPT attempt at the center of the four installations with the 8-tines encountered refusal at a depth of 5 feet. The next CPT attempt encountered refusal at a depth of 10 feet.

Figure 15:
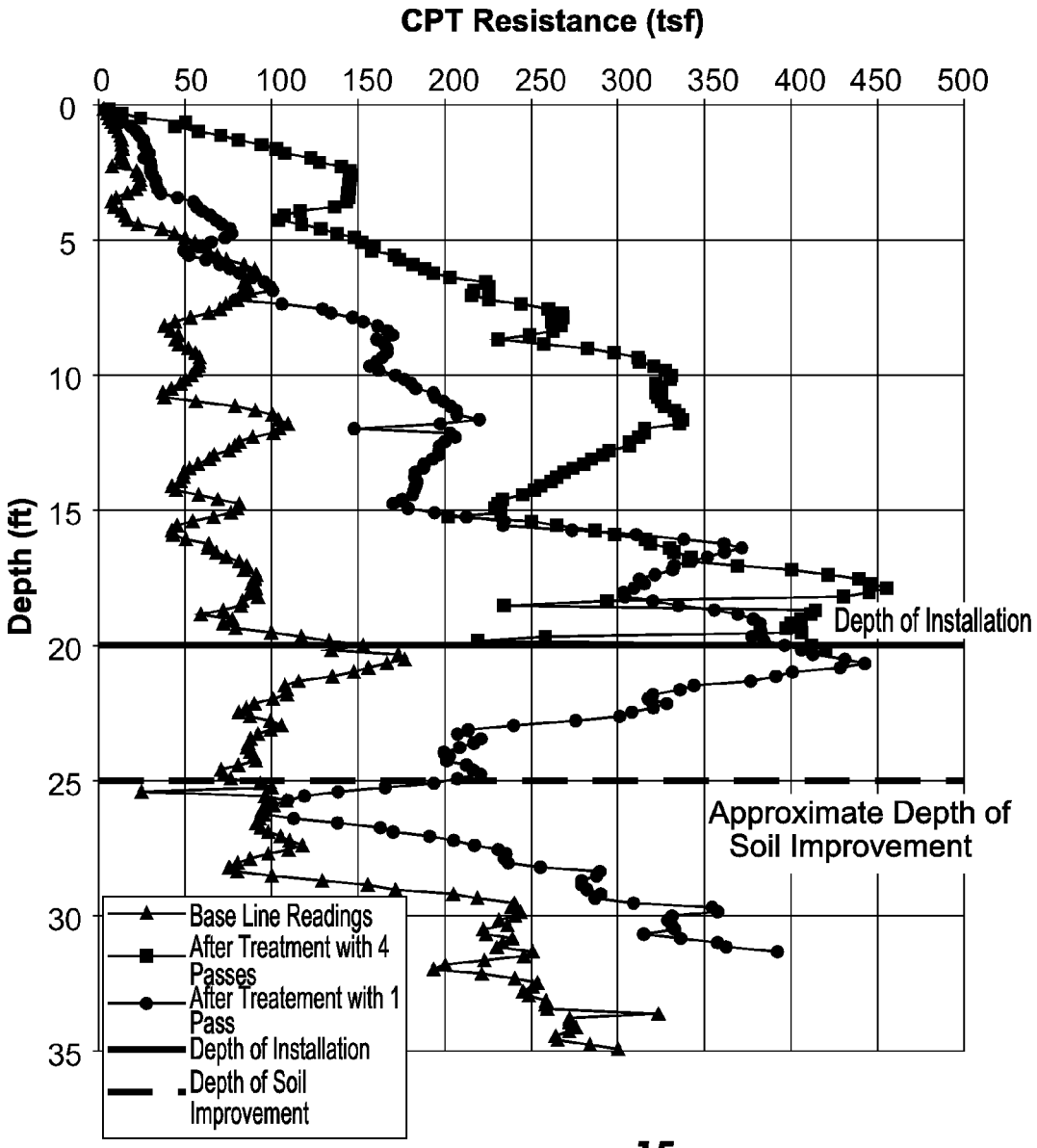
FIG. 15 is a graph illustrating CPT tip resistance results in a natural silty sand site after treatment with a 20 foot long device.

Additional CPT tests were added at the center of different locations in an attempt to quantify soil improvements. The CPT results are presented in FIG. 15.

The baseline CPT readings showed tip resistances of approximately 20 tsf to a depth of 5 feet, approximately 50 tsf to 100 tsf from 5 feet to 20 feet, and approximately 70 tsf to 150 tsf from 20 feet to 30 feet. After treatment with just one pass, the CPT tip resistance values increased with depth from about 25 tsf at one foot to 200 tsf at depths of 10 to 15 feet. The tip resistances were greater than 300 tsf at depths of 15 feet to 20 feet and then decreased back to the baseline readings at about 25 feet. After treatment with four passes, even more improvement occurred with CPT tip resistances increasing to values exceeding 400 tsf at a depth of 20 feet at which depth refusal to pushing occurred.

The test results showed significant soil improvement throughout the depth of installation and substantial improvement to a depth of about twice the width of the top plate 13 below the bottom of the maximum penetration depth of 20 feet. Increased soil improvement occurred with increasing number of passes.

Example IV

In January of 2010, installations were performed at a site located in Oklahoma. The device was used to treat soil for the support of a large steel storage tank. The spacing between individual installation locations was 7 feet on-center. The design of this embodiment was based on previous test results, as described with reference to the above Examples and using the geometry shown in FIGS. 2A and 2B. The field verification program consisted of performing CPT testing before and after installations. Testing included performing baseline readings in untreated areas, pushing the CPT at the compaction locations and pushing the CPT at locations between the compaction locations. The objective of this testing program was to quantify improvement in the matrix soil by verifying the densification obtained after installations were conducted, by means of the CPT.

Installations

The device 15 used was similar to that described above with reference to Example I and shown in FIGS. 2A and 2B.

Borings performed at the site before the installations were made indicate the presence of loose to medium dense sand within the reinforcement zone. The sand was fine-grained with fines content of approximately less than 5%. No groundwater was encountered.

The general procedure consisted of penetrating the tines to full length or a portion of the tine length, followed by retraction and backfilling with native sand. Each pass took approximately ½ minute to 1 minute to accomplish. Each set of 3 passes typically took about 4 minutes. The device sometimes achieved a penetration depth of only 1 to 4 feet during the third pass. Fine sand was used to backfill the cavities in all passes. Installations proceeded from one edge of the tank to the other.

Approximately 3 to 4 inches of ground heave was observed during initial installation in the first pass. Radial cracks were also observed during the first pass extending as far as 5 feet from the edge of the installations. The cavities formed by the tines remained open after each pass. This was aided in part by the moisture observed in the sand.

During the first pass, about 2 cubic yards of sand was added. After that, lesser amounts of sand were needed.

A total of eight test locations were laid out in the field for performing installation verification tests. The test site locations were in the general vicinity of the initial borings performed prior to construction. The tests were performed at installation locations and between adjacent installations. One CPT was performed outside the perimeter of the tank to serve as a baseline reading.

At all of the test site locations, excluding test site location number 8, the ground surface was compacted with three passes of a vibratory drum roller after the installations.

CPT Testing

Figure 16:
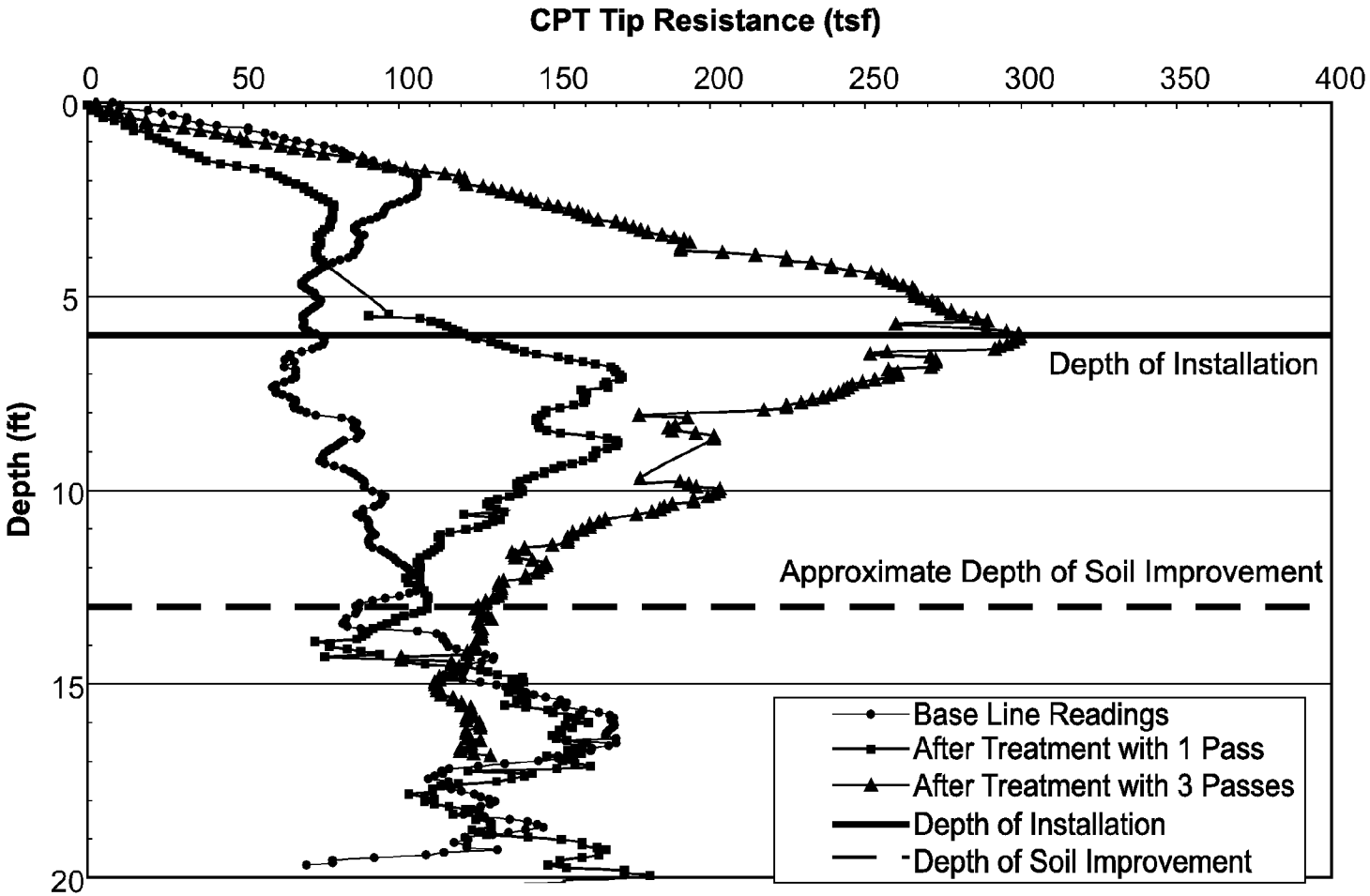
FIG. 16 is a graph illustrating CPT tip resistance results within the compaction footprint of the device installations after treatment with a 6 foot long device.

FIG. 16 presents the results of the baseline CPT readings and the CPT tip resistances at the installation locations. The baseline CPT tip resistances generally ranged from approximately 50 tsf to 100 tsf with an average tip resistance of about 70 tsf between depths of one to 14 feet below grade.

The CPT tip resistances within the footprint of the device installations are also shown on FIG. 16. Significant improvements were observed both in the reinforced zone and below the bottom of the tines to a depth of approximately 13 feet below grade. After treatment with one pass, CPT tip resistances remained near the baseline readings to a depth of about 5 feet but then increased to values exceeding 150 tsf between depths of 6 feet and 9 feet. The tip resistances ranged between 100 tsf and 150 tsf between depths of 9 feet and 13 feet below grade. After treatment with three passes, the CPT tip resistances in the upper 5 feet increased to values of up to and exceeding 250 tsf and increased to values ranging between 130 tsf and 300 tsf between a depth of 5 feet and 13 feet. No increase in tip resistance was observed in the upper 2 feet likely because there is insufficient surface confinement for densification.

Figure 17:
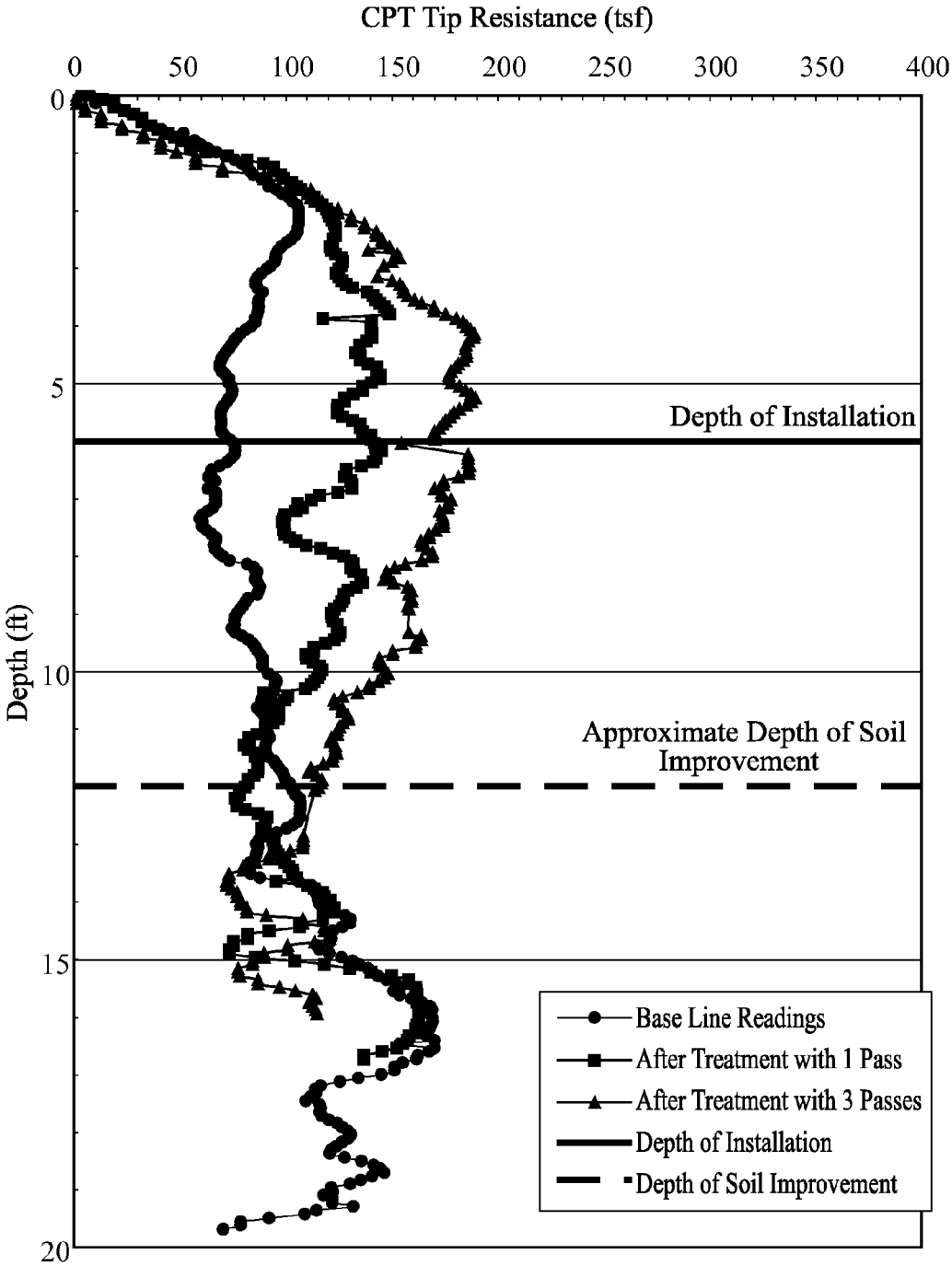
FIG. 17 is a graph illustrating CPT tip resistance results after treatment with a 6 foot long device at locations 2.25 feet from the compaction footprint (between installation locations).

FIG. 17 presents the results of the CPT tip resistance obtained between installation locations. The CPT soundings were advanced at the midpoint between installation locations 3.5 feet from the center of the adjacent elements or 2.25 feet from the edge of the installation locations. The results indicate improvement in density evidenced by increase in tip resistance from installation. After treatment with one pass the tip resistance values increase to values ranging between 100 tsf and 150 tsf at depths ranging between 2 and 10 feet. After treatment with 3 passes, the tip resistances increase to values exceeding 150 tsf at depths ranging between 4 and 10 feet below grade.

Installations with the device of this example increase the tip resistance within the reinforced zone and below the reinforced zone, extending to a depth of up to 13 feet, 7 feet below the bottom of the maximum tine depth. This depth of improvement is greater than twice the width of the top plate 13.

In clean sand, the device increases the tip resistance values between adjacent compaction points. The increase is, on average, two times the tip resistance for unreinforced conditions at an installation spacing of 7 feet on center.

In clean sand, the device increases the tip resistance values within the treatment footprint to up to about 250 tsf or 2 to 4 times the tip resistance for unreinforced conditions. Improvement within and below the reinforced zone, and between adjacent installation occurs from the first device penetration and increases with successive passes.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation.

What is claimed is:

1. A device for ground improvement, comprising:

(a) a top plate having a first surface configured for having a driving device attached thereto to provide impact thereon;

(b) a plurality of vertically extending tines attached to a second surface of the top plate opposite the first surface of the top plate, and horizontally spaced from each other at upper lateral edges thereof, for being driven into a ground surface, wherein the tines have a length of at least three and a half (3.5) feet and comprise a length to spacing (L/S) ratio of greater than two (2), wherein length (L) is the length of the tines and spacing (S) is the spacing between the tines on a tine center-to-center basis; and (c) the tines being shaped, spaced, and oriented relative to each other in a manner to achieve displacement of ground material downward and radially outward.

2. The device of claim 1, wherein the tines comprise a length to spacing (L/S) ratio of approximately four (4).

3. The device of claim 1, wherein the tines are tapered to be narrower at an end away from the top plate than at the attachment to the second surface of the top plate, wherein the tines are tapered at an angle in the range of 0° to 5°.

4. The device of claim 1, wherein the tines have a length in the range of 3.5-30 feet.

5. The device of claim 1, wherein the tines are one selected from the group consisting of circular in cross-section and articulated in cross-section.

6. The device of claim 1, wherein the tines are one selected from the group consisting of substantially flat at an end away from the top plate, substantially pointed at an end away from the top plate, and having a bulbous shape at an end away from the top plate.

7. The device of claim 1, wherein the tines are made of material selected from the group consisting of ferrous material, steel, or composite material.

8. The device of claim 1, wherein the tines are hollow.

9. The device of claim 8, wherein the tines have openings at the ends away from the top plate and respective valves, or optionally sacrificial plates, at the openings for restricting entry of soil during advancement, and for allowing passage of flowable material outward during retraction.

10. The device of claim 1, wherein the plurality of tines comprises five tines horizontally spaced from each other, with four perimeter tines spaced about the periphery of the top plate and surrounding a centrally located tine, wherein the perimeter tines are oriented at 45° about their vertical axis relative to the centrally located tine.

11. The device of claim 1, wherein the plurality of tines comprises eleven tines horizontally spaced from each other, with eight perimeter tines spaced about the periphery of the top plate and surrounding three centrally located tines, wherein the perimeter tines are oriented at 45° about their vertical axis relative to the centrally located tines.

12. The device of claim 1, wherein the plurality of tines comprises eight tines horizontally spaced from each other, with six perimeter tines spaced about the periphery of the top plate and surrounding two centrally located tines, wherein the perimeter tines are oriented at 45° about their vertical axis relative to the centrally located tines.

13. A method for ground improvement, comprising:

(a) providing a device for ground improvement comprised of a top plate having a first surface configured for having a driving device attached thereto to provide impact thereon, and a plurality of vertically extending tines attached to a second surface of the top plate opposite the first surface of the top plate, and horizontally spaced from each other at upper lateral edges thereof, for being driven into a ground surface, wherein the tines have a length of at least three and a half (3.5) feet and comprise a length to spacing (L/S) ratio of greater than two (2), wherein length (L) is the length of the tines and spacing (S) is the spacing between the tines on a tine center-to-center basis, and the tines being shaped, spaced, and oriented relative to each other in a manner to achieve displacement of ground material downward and radially outward;

(b) advancing the device tines into the ground surface;

(c) retracting the tines from the ground surface; and (d) repeating the advancing and retracting until a desired ground condition is achieved.

14. The method of claim 13, wherein the advancing of the tines creates cavities at the location the tines are advanced, and further comprising adding backfill into the cavities and advancing and retracting the device repeatedly after the backfill has been added.

15. The method of claim 14, wherein the tines are hollow and each have an opening at an end away from the surface plate, and further comprising adding the backfill through the tines and out the opening of each tine upon retraction thereof.

16. The method of claim 15, wherein the tines have respective valves at the open ends, and comprising keeping the valves closed upon advancement of the device and opening the valves upon retraction, and adding the backfill through the tines.

17. The method of claim 15, wherein the tines have respective sacrificial plates at the open ends, and comprising securing the sacrificial plates to the tines upon advancement of the device and allowing the sacrificial plates to separate from the tines upon retraction, and adding the backfill through the tines.

18. The method of claim 14, wherein the backfill is one of or a combination of crushed stone, sand, aggregate, gravel, grout, concrete, lime, fly ash, waste materials, tire chips, recycled materials, and other flowable substances.

19. The method of claim 13, wherein the tines comprise a length to spacing (L/S) ratio of approximately four (4).

20. The method of claim 13, wherein the level of ground improvement achieved is measured through a monitoring of downward pressure during penetration for a determination of degree of densification.

* * * * *